US005570705A

United States Patent [19]

Burke

[11] Patent Number: 5,570,705

[45] Date of Patent: Nov. 5, 1996

[54] FACIAL RESTRAINT FOR INCARCERATED PERSON

[76] Inventor: George Burke, 912 NE. 22nd St., Gainesville, Fla. 32601

[21] Appl. No.: 396,615

[22] Filed: Mar. 1, 1995

[51] Int. Cl.[6] ..... A61B 19/00

[52] U.S. Cl. ..... 128/869; 128/918; 128/857

[58] Field of Search ..... 128/842, 844, 128/918, 857, 858, 859, 869; 2/206, 2, 9

[56] References Cited

U.S. PATENT DOCUMENTS

| | | | |
|---|---|---|---|
| 2,276,612 | 3/1942 | Ellis | 128/857 |
| 2,509,519 | 5/1950 | Norris | 2/206 |
| 4,821,340 | 4/1989 | Johnson | 2/9 |
| 4,974,605 | 12/1990 | Esqueda | 128/857 |
| 5,035,006 | 7/1991 | Hetz | 2/206 |
| 5,320,112 | 6/1994 | Bloodsaw | 128/842 |

*Primary Examiner*—Michael A. Brown
*Attorney, Agent, or Firm*—Finnegan, Henderson, Farabow, Garrett & Dunner, L.L.P.

[57] ABSTRACT

A BA-1 protection mask comprising a covering to fit against a face, under the eyes, so as to extend over the nose below the bridge, mouth, chin, jaw and cheeks up to the ears of an incarcerated individual. A facility in the covering is for allowing the incarcerated individual to breath freely. An assembly is for securing the covering to the face of the incarcerated individual, so as to prevent the incarcerated individual from biting and spitting, while the safety and health of police officers and other escorts thereabout will be maintained.

6 Claims, 2 Drawing Sheets

FACIAL RESTRAINT FOR INCARCERATED PERSON

BACKGROUND OF THE INVENTION

1. Field of the Invention

The instant invention relates generally to face protectors and more specifically it relates to a BA- 1 protection mask.

Danger in the street goes beyond semiautomatic weapons, knives and assaults from personal weapons, such as arms, fists and feet performed by perpetrators. Today police officers are routinely carrying surgical gloves and masks to deal with the risks of contact with Aids, ARC and HIV related diseases. The dangers are real, since contact with body fluids such as blood and saliva can transmit these diseases. A biting incident that breaks the skin and draws blood is especially risky. However, even minor cuts on the hands or arms of an officer may present an opportunity to contract HIV through contact with a person's blood or saliva. And since police officers may have to routinely handle aggressive situations, the chances for coming into contact with such body fluids are substantial.

Further, AIDs, ARC and HIV infection in the population are expected to increase in the future. It is estimated that the current number of people with HIV is at 1.9 to 3 million. The projected numbers will increase to as high as 15 million by the year 2002, if no significant breakthroughs in medical treatment or social behavior occur. In this gloomy forecast, 2.9 percent of whites, 9.2 percent of Hispanics and 41.8 percent of blacks between the ages of 15 and 50 could carry the disease.

For a police officer, getting a person restrained on the street is just part of the problem. The arrested person must be transported to the police station for processing and detention. While incarcerated, the person interacts with a variety of persons, such as corrections officers, public defenders, investigating officers, health and social services personnel, even judges and juries. Anyone who was arrested exhibiting aggressive behavior could conceivably become aggressive again at any point in the future. Such an incarcerated person could conceivably pose an HIV risk to anyone he interacted with, even other prisoners.

2. Description of the Prior Art

Numerous face protectors have been provided in prior art. For example, U.S. Pat. Nos. 2,616,081 to Weaver et al.; 3,886,596 to Franklin et al.; 3,943,574 to Yamaguichi et al. and 4,754,501 to Yahn and Canadian patent number 619,535 to Tielemans all are illustrative of such prior art. While these units may be suitable for the particular purpose to which they address, they would not be as suitable for the purposes of the present invention as heretofore described.

WEAVER, JOHN N.

DAVIS, GEORGE W.

FACE PROTECTING MASK

U.S. Pat. No. 2,616,081

A transparent shock absorbing mask to be secured on the wearer's head and over his face comprising a main portion formed of rigid non-shattering transparent material. The main portion is adapted to cover the forehead, nose, cheekbones and chin and extends from the forehead over the nose and over the cheekbones to a position under the chin. A plurality of widely spaced apart shock absorbing cushions are attached to the transparent main portion. The cushions are adapted to rest against the forehead, cheekbones and chin of the face leaving the remaining portion of the main portion spaced away from the face to protect the flesh features of same.

FRANKLIN, CHARLOTTE S.

FRANKLIN, BURTON P.

FACE GUARD FOR A BASEBALL

HELMET OR THE LIKE

U.S. Pat. No. 3,886,596

A protective face guard for a helmet is disclosed and comprises a specially formed and ribbed sheet of material which is able to withstand the impact of a hit ball. It is fastened to the helmet by novel ribbed connector means through which the force of impact is distributed over a substantially large area of the helmet.

YAMAGUCHI, TAKESHI

IMAI, KOICHIRO

SKI-MASK

U.S. Pat. No. 3,943,574

A face mask, particularly a ski-mask, comprising a transparent mask body with an interceptive function against the ultraviolet rays and formed to have a curved surface spaced from the skier's face. A pair of ear protectors are formed in a bowl-like shape for convenience in covering the ears of the skier and are pivotably supporting both side ridge portions of the mask body by the outer side wall thereof. Lock-on members are adapted to stop turning round of the mask body relative to the ear protectors and then make it stand still against the ear protector at a desired position. Protection of the entire face of the skier, including both of his ears, is ensured from the ultraviolet rays and the cold wind as well as the wind pressure, besides other accidents. Delicate adjustment can be achieved for positioning the mask body as required relative to the skier's face.

YAHN, DONALD H.

PROTECTIVE HEADWARE FOR WRESTLERS

U.S. Pat. No. 4,754,501

A protective headware for wrestlers which covers the top of the head and extends downwardly over a portion of the back of the head and down over the face including the nose, mouth and ears and then extends under the chin of the wrestler. It has an outer flush surface on each side of the head and is internally formed with indentations into which the ears of the wrestler are received. A back strap is used to hold the head gear in place. Top and mouth ventilating openings are provided for ventilating purposes.

TIELEMANS, JACQUES

FACE PROTECTOR

Canadian Patent Number 619,535

A face protector made of a polyester resin reinforced with layers of woven glass fibers consisting of a rigid one piece element is adapted to fit the face of the wearer for overlying the forehead, nose, cheeks and chin. The element has eye apertures and nose and mouth openings. A first rib surrounds the mouth opening at the exterior of the protector. A second rib extends transversely of the protector over the nose overlying portion and along the nose opening. The second rib extended on each side of the nose overlying portion onto the cheek overlying portions.

SUMMARY OF THE INVENTION

The BA-1 protection mask is a disposable restraint device that could prevent an incarcerated person from spitting upon or biting a law enforcement officer. This device could be made principally of a flexible and elastic material such as transparent polyurethane film. The mask would cover a person's face from under the jaw to the bridge of the nose and from ear to ear. A set of reusable elastic or hook and loop VELCRO straps would be used to secure the mask at the back of the head and neck. Slots in the mask, located at positions just above and below the ears, would serve as the fastening means for the straps. To permit free breathing, the mask would have a total of eleven air vest holes. Two of these air vent holes would be for the right and left nostrils. The remaining nine air vent holes would be distributed in sets of three, located at the right and left of the mouth and at the chin. For ease of availability and use, a plurality of the BA-1 protection masks may be carried in a belt pouch which may be worn upon an officer's service belt.

A primary object of the present invention is to provide a BA-1 protection mask that will overcome the shortcomings of the prior art devices.

Another object is to provide a BA-1 protection mask that will fully restrain an incarcerated individual in such a manner as to prevent biting or spitting without impairing free breathing.

An additional object is to provide a BA-1 protection mask which would fulfill the need for a useful restraint device that could protect the safety and health of an arrested individual as well as that of the police officer or other escorts.

A further object is to provide a BA-1 protection mask that is disposable and intended for a one-time use, so that it would meet public health requirements for the safety of the incarcerated person.

A still further object is to provide a BA-1 protection mask that is simple and easy to use, while being economical in cot to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope Of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
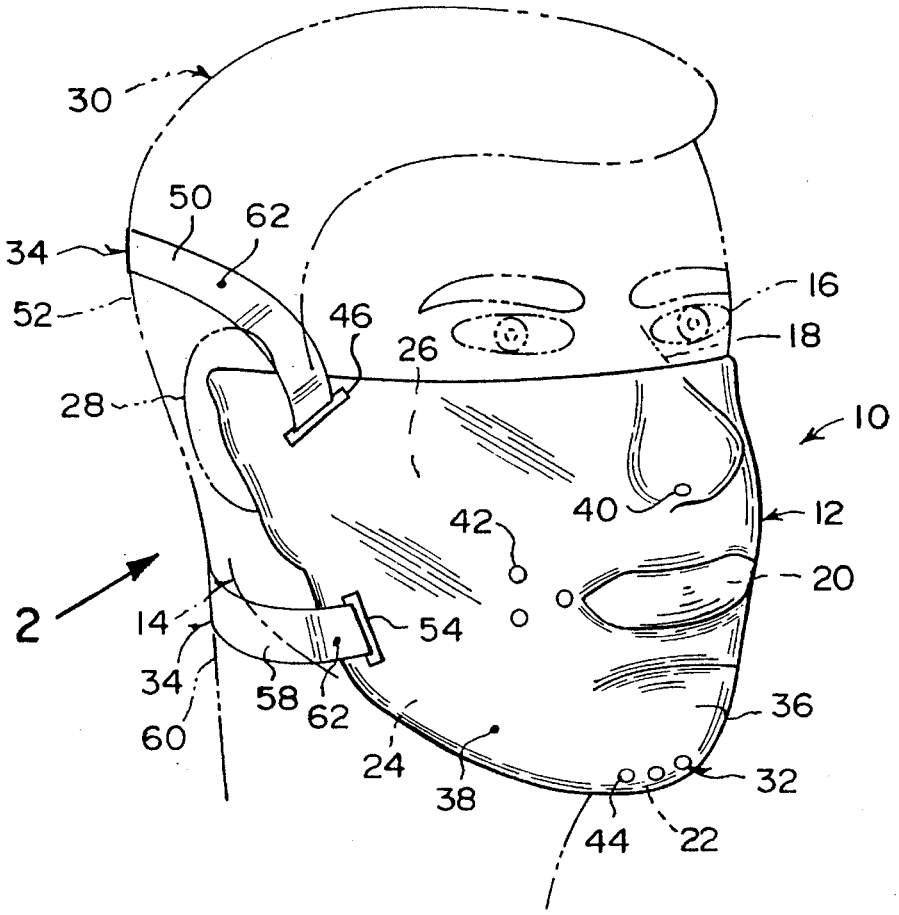
FIG. 1 is a perspective view of the instant invention worn on a person's face that is indicated by phantom lines.
Figure 2:
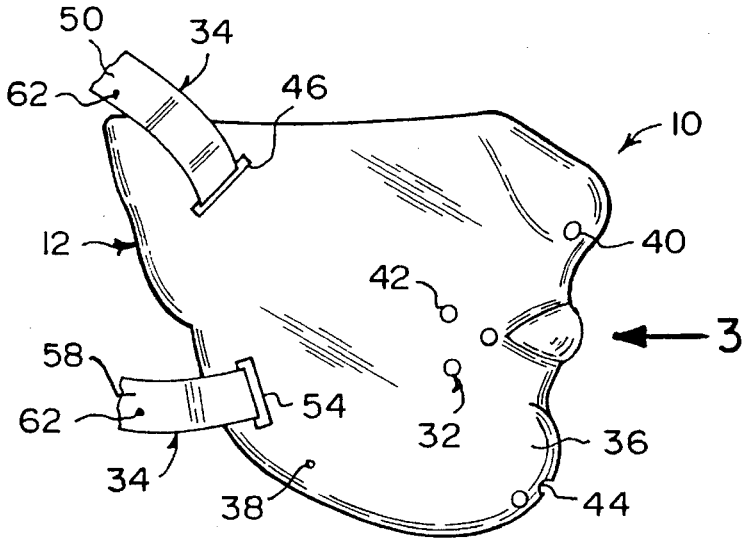
FIG. 2 is a left side view of the instant invention per se taken in the direction of arrow 2 in FIG. 1, with the straps broken away.
Figure 3:
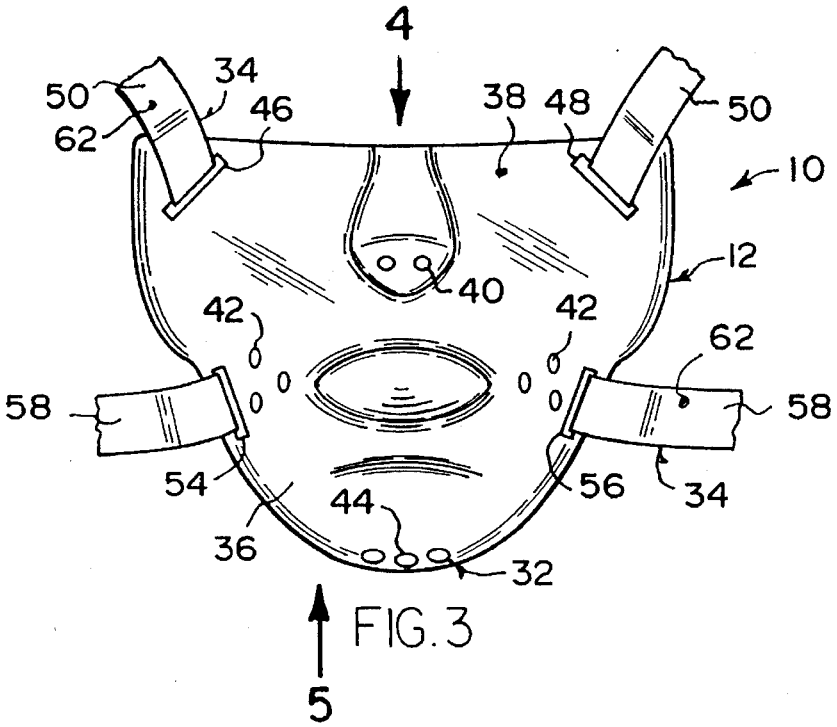
FIG. 3 is a front view taken in the direction of arrow 3 in FIG. 2.
Figure 4:
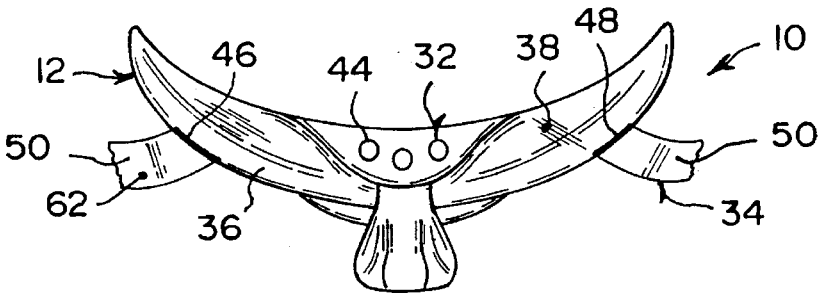
FIG. 4 is a top view taken in the direction of arrow 4 in FIG. 3.
Figure 5:
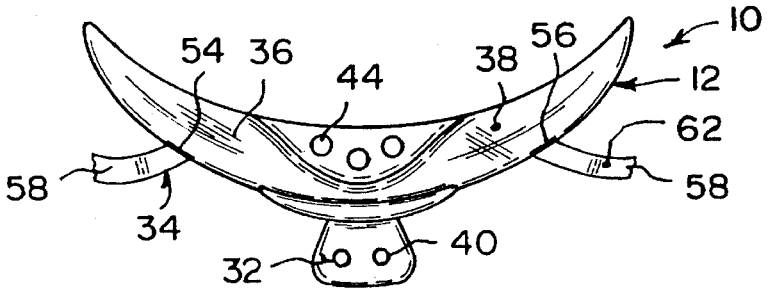
FIG. 5 is a bottom view taken in the direction of arrow 5 in FIG. 3.

Turning now descriptively to the drawings, in which similar reference characters denote similar elements throughout the several views, FIGS. 1 through 5 illustrate a BA-1 protection mask 10 comprising a covering 12 to fit against a face 14, under the eyes 16, so as to extend over the nose 18 below the bridge, mouth 20, chin 22, jaw 24 and cheeks 26 up to the ears 28 of an incarcerated individual 30. A facility 32 in the covering 12 is for allowing the incarcerated individual 30 to breath freely. An assembly 34 is for securing the covering 12 to the face 14 of the incarcerated individual 30, so as to prevent the incarcerated individual 30 from biting and spitting, while the safety and health of police officers and other escorts thereabout will be maintained.

The covering 12 is a thin piece of flexible and elastic material 36 that is formed to contour about the nose 18 below the bridge, mouth 20, chin 22 jaw 24 and cheeks 26 up to the ears 28 of the incarcerated individual 30. The flexible and elastic material 36 is a transparent polyurethane film 38.

The free breathing facility 32 includes the covering 12 having two air vent holes 40, in which each air vent hole 40 is located at the right and left nostrils, to permit free breathing through the nose 18. The free breathing facility 32 further includes the covering 12 having six additional air vent holes 42. Three of the air vent holes 42 are located at the right of the mouth 20 at the right cheek 26. The other three air vent holes 42 are located at the left of the mouth 20 at the left cheek 26, to permit free breathing through the mouth 20. The covering 12 has three more additional air vent holes 44 located at the chin 22 to also permit free breathing through the mouth 20.

The securing assembly 34 consists of the covering 12 having a pair of upper slots 46, 48. The first upper slot 46 is located at the right cheek 26 adjacent the right ear 28. The second upper slot 48 is located at the left cheek 26 adjacent the left ear 28. An upper strap 50 engages with the pair of upper slots 46, 48 and extends about the head 52 of the incarcerated individual 30.

The securing facility 34 further consists of the covering 12 having a pair of lower slots 54, 56. The first lower slot 54 is located at the right cheek 26, above the jaw 24 and below the right ear 28. The second lower slot 56 is located at the left cheek 26 above the jaw 24 and below the left ear 28. A lower strap 58 engages with the pair of lower slots 54, 56 and extends about the neck 60 of the incarcerated individual 30.

The upper and lower straps 50, 58 are fabricated out of a nylon web material 62. The upper and lower straps 50, 58 are sized between one half to three quarters of an inch in width. The upper and lower straps 50, 58 can be elastic, so as to be adjustable. The upper and lower straps 50, 58 can also be VELCRO, so as to be adjustable.

This concept takes the protective advantages of a surgical mask and places it where it could do the most good on the face 14 of the arrested or incarcerated individual 30. Moreover, the BA-1 protection mask 10 would not be just a barrier; it would also be a restraint device. Its elastic and one size fits all design would restrain the incarcerated individual 30 from both under and above the jaw 24. The nylon straps 50, 58 with hook and loop VELCRO fasteners would be used to secure it from slots 46, 48 and 54, 56 located at the edges of the covering 12, just above and below the ears 28.

The officer could place the BA-1 protection mask 10 on an incarcerated individual 30, by standing behind the incarcerated individual 30, orienting the covering 12 and pulling the lower straps 58 tight and secure. The upper straps 50 could then be similarly secured. Now the incarcerated individual 30 could not spit at or bite anyone, yet could breathe freely. The two nostril air vent holes 40 would permit free breathing through the nose 18, while the other air vent holes 42, 44 at the cheeks 26 and below the jaw 24 would permit the incarcerated individual 30 to breathe through the mouth 20. The elastic and taut nature of the secured covering 12 would substantially limit the incarcerated individual's jaw movement to prevent aggressive biting attempts. The mask's full face coverage would also serve as a functional barrier. While deterring spitting because of the concerns for AIDs and related HIV infection would be a primary objective of the BA-1 protection mask 10, it could also prevent the spread of infections from airborne viruses such as tuberculosis.

The BA-1 protection mask 10 would be disposable and intended for a one time use, to meet the public health needs of the incarcerated individual 30. The straps 50, 58 could be reused many times to make the BA-1 protection mask 10 affordable for routine use in handling newly arrested incarcerated individuals 30, as well as for the short term and long term incarcerated individuals 30.

As a general approach to production, the BA-1 protection mask 10 could be produced from a suitable grade of FDA approved polyurethane film 38. The restraint straps 50, 58 could be produced from one half or three quarters of an inch wide nylon web material with integral hook and loop fasteners. The belt pouch for carrying several BA-1 protection masks 10 could be made from rip stop nylon, double and triple stitched with power sewing equipment. Hook and loop fasteners could be used as closures on the belt pouch as well.

The BA-1 protection mask 10 could be packaged in a corrugated cardboard box. The box could be imprinted in one or more colors, including a four-color process. A small pamphlet could be included in each package detailing instructions for use and care. Styrofoam inserts could be inserted into the package to protect the product. Corrugated cardboard shipping containers would then be used to hold a quantity of individually packaged products to facilitate shipment and storage.

LIST OF REFERENCE NUMBERS

10 BA-1 protection mask
12 covering
14 face of 30
16 eye of 30
18 nose of 30
20 mouth of 30
22 chin of 30
24 jaw of 30
26 cheek of 30
28 ear of 30
30 incarcerated individual
32 free breathing facility
34 securing assembly
36 flexible and elastic material of 12
38 transparent polyurethane film for 36
40 air vent hole of 32 in 12
42 air vent hole of 32 in 12
44 air vent hole of 32 in 12
46 first upper slot of 34 in 12
48 second upper slot of 34 in 12
50 upper strap of 34
52 head of 30
54 first lower slot of 34 in 12
56 second lower slot of 34 in 12
58 lower strap of 34
60 neck of 30
62 nylon web material for 50, 58

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A facial restraint for incarcerated person, comprising:

a covering of material sufficiently strong that it cannot be readily bitten through or torn, and shaped to extend over the nose, mouth, chin and cheeks of the incarcerated person, the covering having an impervious area to overlie the mouth of the incarcerated person and a plurality of small apertures on each side of the impervious area to enable passage of air through the apertures and around the impervious area to the persons mouth; and retaining means in the form of straps for securely holding the covering against the face of the incarcerated person, thereby to protect a person in the presence of the incarcerated person from being bitten and being spat upon from the mouth of the incarcerated person without impeding breathing by the incarcerated person, said covering being a molded sheet of flexible and elastic transparent polyurethane shaped to contour about the nose below the bridge, mouth, chin, jaw and cheeks up to the ears of the incarcerated person.

2. A facial restraint as recited in claim 1, further including two air vent holes located at the right and left nostrils, to permit free breathing through the nose.

3. A facial restraint for incarcerated person, comprising:

a covering of material sufficiently strong that it cannot be readily bitten through or torn, and shaped to extend over the nose, mouth, chin and cheeks of the incarcerated person, the covering having an impervious area to overlie the mouth of the incarcerated person and a plurality of small apertures on each side of the impervious area to enable passage of air through the apertures and around the impervious area to the persons mouth; and retaining means in the form of straps for securely holding the covering against the face of the incarcerated person, thereby to protect a person in the presence of the incarcerated person from being bitten and being spat upon from the mouth of the incarcerated person without impeding breathing by the incarcerated person, said covering having a first upper slot located at the right cheek adjacent the right ear, second upper slot located at the left cheek adjacent the left ear, a first lower slot located at the right cheek above the jaw and below the right ear, and a second lower slot located at the left cheek above the jaw and below the left ear, said retaining straps including an upper strap to engage with said pair of upper slots and extend about the head of the incarcerated person, and a lower strap to engage with said pair of lower slots and extend about the neck of the incarcerated person, said upper and lower straps being fabricated out of a nylon web material.

4. A facial restraint as recited in claim 3, wherein said upper and lower straps are sized between one half to three quarters of an inch in width.

5. A facial restraint as recited in claim 4, wherein said upper and lower straps are elastic, so as to be adjustable.

6. A facial restraint as recited in claim 4, wherein said upper and lower straps include hook and loop fasteners, so as to be adjustable.

* * * * *